US007878779B2

(12) United States Patent
Koehler et al.

(10) Patent No.: US 7,878,779 B2
(45) Date of Patent: Feb. 1, 2011

(54) VANE PUMP WITH HOUSING END WALL HAVING AN ANNULAR GROOVE AND A PRESSURE GROOVE THAT COMMUNICATE VIA A CURVED CONNECTING GROOVE

(75) Inventors: Achim Koehler, Ditzingen (DE); Christian Langenbach, Affalterbach (DE); Joerg Wuerz, Stuttgart (DE); Joerg Morlok, Weissach (DE)

(73) Assignee: Robert Bosch GmbH, Stuttgart (DE)

( * ) Notice: Subject to any disclaimer, the term of this patent is extended or adjusted under 35 U.S.C. 154(b) by 766 days.

(21) Appl. No.: 11/721,347

(22) PCT Filed: Nov. 16, 2005

(86) PCT No.: PCT/EP2005/056012

§ 371 (c)(1),
(2), (4) Date: Jun. 11, 2007

(87) PCT Pub. No.: WO2006/063913

PCT Pub. Date: Jun. 22, 2006

(65) Prior Publication Data

US 2009/0291010 A1 Nov. 26, 2009

(30) Foreign Application Priority Data

Dec. 16, 2004 (DE) ..... 10 2004 060 554

(51) Int. Cl.
*F03C 4/00* (2006.01)
*F04C 15/00* (2006.01)
*F04C 2/00* (2006.01)

(52) U.S. Cl. ..... 418/81; 418/79; 418/82; 418/268

(58) Field of Classification Search ..... 418/79–81, 418/82, 93, 259, 266–268
See application file for complete search history.

(56) References Cited

U.S. PATENT DOCUMENTS 2,004,958 A * 6/1935 Mitchell ..... 418/81

(Continued)

FOREIGN PATENT DOCUMENTS

DE 19529806 A1 2/1997

(Continued)

*Primary Examiner*—Theresa Trieu
(74) *Attorney, Agent, or Firm*—Ronald E. Greigg

(57) ABSTRACT

The vane pump has a housing containing a rotor driven by a drive shaft. A number of grooves are distributed over the rotor circumference and extend in a substantially radial direction of the rotor, in each of which grooves a wing-shaped delivery element is guided in sliding fashion. The rotor is surrounded by a circumferential wall that extends eccentrically in relation to its rotation axis against which the radially outer ends of the delivery elements rest. Housing end walls of the pump housing adjoin the rotor in the direction of its rotation axis. An annular groove encompassing the rotation axis of the rotor is provided in at least one of the housing end walls and is situated opposite the radially inner regions of the grooves of the rotor and communicates with the pressure region via a connecting groove in the housing end wall. The connecting groove extends from the pressure region radially inward in the rotation direction of the rotor to the annular groove.

12 Claims, 2 Drawing Sheets

U.S. PATENT DOCUMENTS

| | | | | |
|---|---|---|---|---|
| 2,423,271 | A * | 7/1947 | Talbot | 418/258 |
| 2,544,987 | A | 3/1951 | Gardiner et al. | |
| 2,653,550 | A | 9/1953 | Gardiner et al. | |
| 3,574,493 | A | 4/1971 | Hamilton | |
| 4,455,129 | A | 6/1984 | Sakitani et al. | |
| 5,147,183 | A | 9/1992 | Gettel | |
| 5,188,522 | A | 2/1993 | Hara | |
| 5,265,457 | A | 11/1993 | Hayashi et al. | |
| 2008/0253913 | A1 | 10/2008 | Langenbach et al. | |

FOREIGN PATENT DOCUMENTS

| | | | |
|---|---|---|---|
| DE | 19952167 | A1 | 6/2000 |
| GB | 186271 | A | 9/1922 |
| JP | 63167089 | A | 7/1988 |
| JP | 63280883 | A | 11/1988 |
| JP | 1155096 | A | 6/1989 |
| WO | 2007039405 | A1 | 4/2007 |

* cited by examiner

VANE PUMP WITH HOUSING END WALL HAVING AN ANNULAR GROOVE AND A PRESSURE GROOVE THAT COMMUNICATE VIA A CURVED CONNECTING GROOVE

CROSS-REFERENCE TO RELATED APPLICATION

This application is a 35 USC 371 application of PCT/EP 2005/056012 filed on Nov. 16, 2005.

BACKGROUND OF THE INVENTION

1. Field of the Invention

The invention is directed to an improved rotary vane pump.

2. Description of the Prior Art

A vane pump known from DE 199 52 167 A1 has a pump housing that contains a rotor which is driven in rotary fashion by a drive shaft. The rotor has a number of grooves distributed over its circumference that extend at least essentially in the radial direction in relation to the rotation axis of the rotor, in each of which a wing-shaped delivery element is guided in sliding fashion. The pump housing has a circumferential wall surrounding the rotor and arranged eccentrically in relation to its rotation axis, against which the radially outer ends of the wings rest. The pump housing has housing end walls that adjoin the rotor in the direction of its rotation axis. As the rotor rotates, because of the eccentric arrangement of the circumferential wall, expanding and contracting chambers are formed between the wings, between which chambers the medium to be delivered is conveyed by means of a pressure increase from a suction region to a pressure region that is offset from it in the circumferential direction. Due to centrifugal forces, as the rotor rotates, the wings are kept in contact with the circumferential wall; but particularly when the vane pump is starting up, at a low speed, only slight centrifugal forces are generated so that the vane pump only delivers a small amount. In the known vane pumps, a housing end wall is provided with an annular groove extending over part of the circumference of the rotor, which groove is supplied with compressed medium by another delivery pump that forms a joint pump assembly together with the vane pump. The annular groove communicates with the radially inner regions in the grooves of the rotor that are delimited by the wings. In addition to the centrifugal force, the increased pressure in the inner regions of the grooves pushes the wings radially outward toward the circumference wall. But this measure is only possible if the additional delivery pump is provided. Furthermore, the annular groove extending over only a part of the circumference of the rotor is only able to exert pressure on the inner regions over a corresponding part of a rotation of the rotor, as a result of which under some circumstances, there is only a slight contact force of the wings against the circumferential wall.

SUMMARY AND ADVANTAGES OF THE INVENTION

The vane pump according to the invention has the advantage over the prior art that pressure is exerted on the radially inner regions of the grooves in the rotor by means of the pressure that the vane pump itself generates. The annular groove extending over the entire circumference of the rotor improves the exertion of pressure on the inner regions of the grooves of the rotor. In the inwardly extending connecting groove, the rotation of the rotor also generates a drag flow that produces a pressure increase in the annular groove, which in turn leads to a pressure increase in the inner regions of the grooves of the rotor that communicate with the annular groove. This drag flow is intensified with increasing speed of the rotor so that the pressure of the delivery elements against the circumferential wall is further intensified as the speed increases. The curvature of the connecting groove also results in the fact that the delivery elements sweep across it virtually at right angles, minimizing the danger of a tipping and/or tilting of the delivery elements as they sweep across the connecting groove.

Advantageous embodiments and modifications of the vane pump according to the invention are disclosed. One embodiment permits a low-loss influx and outflow via the connecting groove while another embodiment makes it possible to minimize a leakage from the annular groove toward the radial inside.

BRIEF DESCRIPTION OF THE DRAWINGS

Two exemplary embodiments of the invention explained in detail in the description that follows, taken in conjunction with the drawings, in which.

DESCRIPTION OF THE PREFERRED EMBODIMENTS

Figure 1:
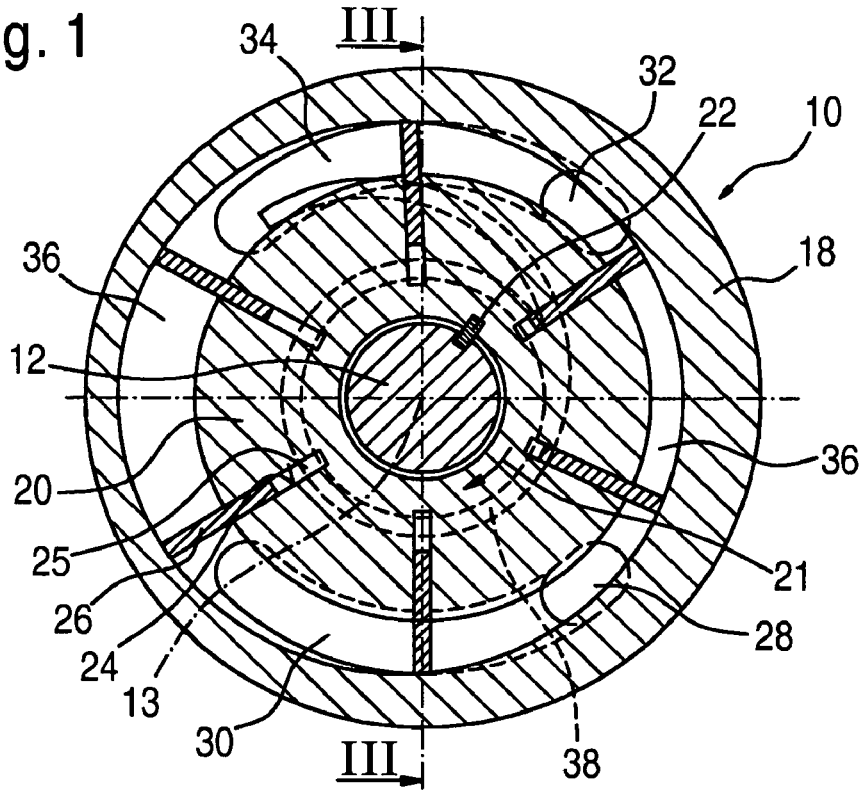
FIG. 1 is a simplified cross-sectional view, taken along line I-I of FIG. 3 of a vane pump embodying the invention.
Figure 2:
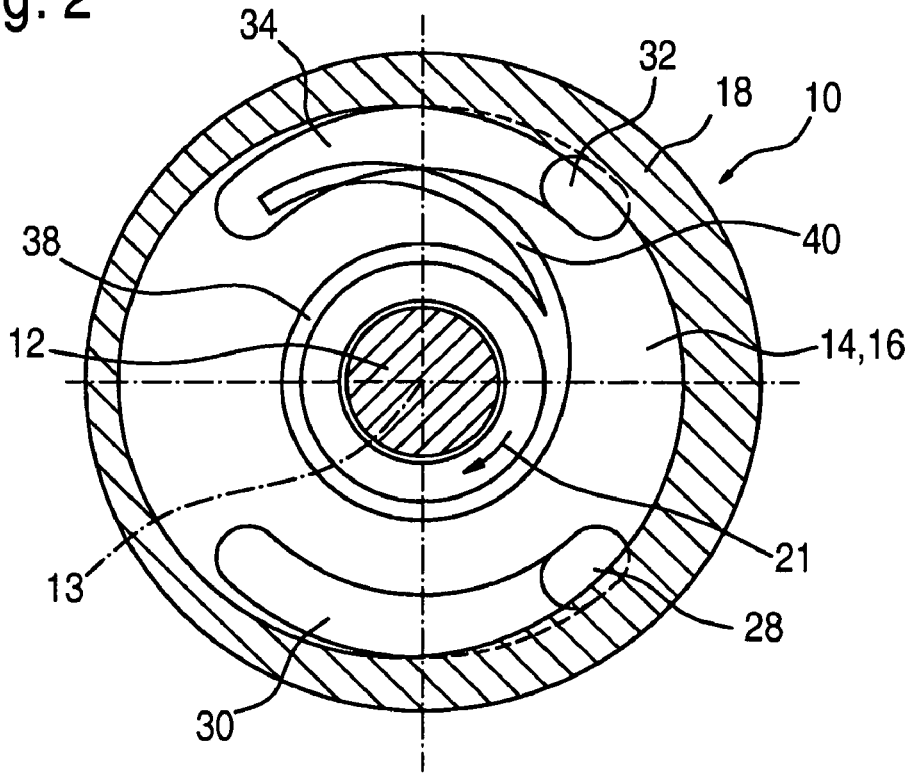
FIG. 2 shows the vane pump according to a first exemplary embodiment, in a cross section along the line II-II in FIG. 3.
Figure 3:
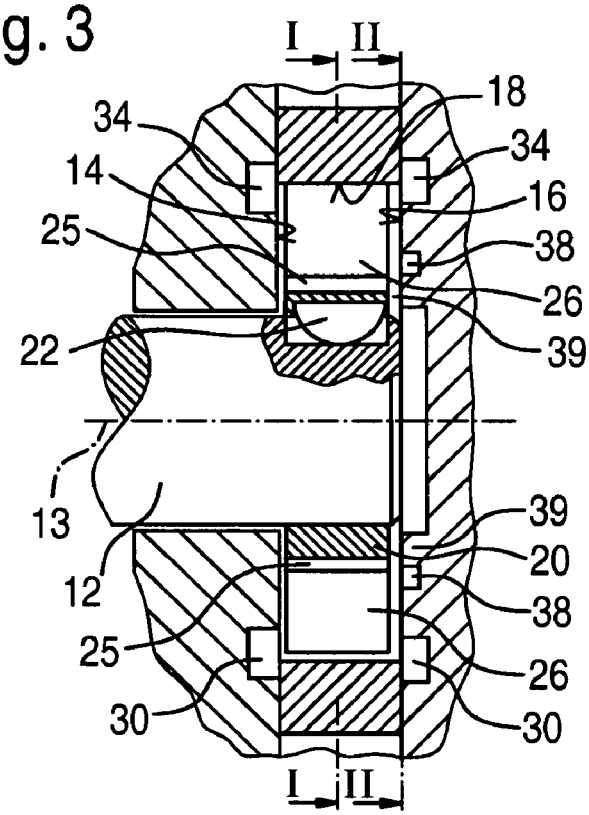
FIG. 3 shows the vane pump in a longitudinal section along the line III-III in FIG. 1.

FIGS. 1 through 4 show a vane pump that is preferably provided for delivering fuel, in particular diesel fuel from a tank to a high-pressure pump. The vane pump can be situated separately from the high-pressure pump, can be mounted onto the high-pressure pump, or can be integrated into the high-pressure pump. The vane pump has a pump housing 10, which is comprised of several parts, and has a drive shaft 12 that protrudes into the pump housing 10. The pump housing 10 has two housing end walls 14, 16 that delimit a pump chamber in the axial direction, i.e. in the direction of the rotation axis 13 of the drive shaft 12. In the circumferential direction, the pump chamber is delimited by a circumferential wall 18 that can be integrally joined to one of the housing end walls 14, 16 or can be embodied as separate from them.

The pump chamber contains a rotor 20 that is connected in non-rotating fashion to the drive shaft 12, for example by means of a groove/spring connection 22. The rotor 20 has a number of grooves 24 distributed over its circumference, extending at least essentially in the radial direction in relation to the rotation axis 13 of the rotor 20. The grooves 24 extend from the outer surface of the rotor 20 into the rotor 20 in the direction toward the rotation axis 13. For example, six grooves 24 may be provided; it is also possible for more or less than six grooves 24 to be provided. Each groove 24 accommodates a plate-shaped vane or delivery element 26 in sliding fashion, which will be referred to below as a wing and whose radially outer end region protrudes out from the groove 24.

The inside of the circumferential wall 18 of the pump housing 10 is embodied as eccentric to the rotation axis 13 of the rotor 20, for example in the form of a circle or another shape. In at least one housing end wall 14, 16, a suction region is provided into which at least one suction opening 28 feeds.

In the suction region, preferably in at least one housing end wall 14, 16, an approximately kidney-shaped, curved suction groove 30 that is elongated in the circumferential direction of the rotor 20 is provided, into which the suction opening 28 feeds. The suction opening 28 feeds into the suction groove 30 preferably in its end region oriented counter to the rotation direction 21 of the rotor 20. The suction opening 28 is connected to an inlet leading from the tank. In at east one housing end wall 14, 16, a pressure region is also provided into which at least one pressure opening 32 feeds. In the pressure region, preferably in at least one housing end wall 14, 16, an approximately kidney-shaped, curved pressure groove 34 that is elongated in the circumferential direction of the rotor 20 is provided, into which the pressure opening 32 feeds. The pressure opening 32 feeds into the pressure groove 34 preferably in its end region oriented in the rotation direction 21 of the rotor 20. The pressure opening 32 is connected to an outlet leading to the high-pressure pump. The suction opening 28, the suction groove 30, the pressure opening 32, and the pressure groove 34 are situated close to the inside of the circumferential wall 18, spaced radially apart from the rotation axis 13 of the rotor 20. The wings 26 rest with their radially outer ends against the inside of the circumferential wall 18 and slide along it in the rotation direction 21 as the rotor 20 rotates. The eccentric embodiment of the inside of the circumferential wall 18 in relation to the rotation axis 13 of the rotor 20 produces chambers 36 with changing volumes between the wings 26. The suction groove 30 and the suction opening are situated in a circumferential region in which the volume of the chambers 36 increases as the rotor 20 rotates in the rotation direction 21, as a result of which these chambers are filled with fuel. The pressure groove 34 and the pressure opening 32 are situated in a circumferential region in which the volume of the chambers 36 decreases as the rotor 20 rotates in the rotation direction, as a result of which fuel is displaced from them into the pressure groove 34 and from this, into the pressure opening 32.

In at least one housing end wall 14, 16, an annular groove 38 is provided that communicates with the pressure groove 34 via a connecting groove 40. The annular groove 38 is situated spaced apart from the rotation axis 13 of the rotor 20 such that it is situated opposite from the radially inner regions in the grooves 24 of the rotor 20 that are delimited by the wings 26. The annular groove 38 is at least approximately concentric to the rotation axis 13 of the rotor 20 and between this annular groove 38 and the drive shaft 12, a sealing region 39 is formed in which there is only a small axial distance between the rotor 20 and the adjoining housing end wall 14, 16. In the region around the drive shaft 12 only a low pressure prevails so that there is a pressure drop between the annular groove 38 and the region around the drive shaft 12. The connecting groove 40 extends in such a way that it approaches the annular groove 38 in the rotation direction 21 of the rotor 20. In addition, the connecting groove 40 preferably extends in a curved fashion, particularly in spiral fashion. The connecting groove 40 preferably feeds at least approximately tangentially into the pressure groove 34 at one end and/or at least approximately tangentially into the annular groove 38 and the other end. Preferably, the connecting groove 40 feeds into the end region of the pressure groove 34 oriented counter to the rotation direction 21 of the rotor 20. Through the connection of the annular groove 38 to the pressure groove 34, an elevated pressure prevails in the annular groove 38 and therefore in the inner regions of the grooves 24 of the rotor 20 that communicate with it, which increases the contact pressure of the wings 26 against the inside of the circumference wall 18, thus improving the delivery capacity of the vane pump. The curved path of the connecting groove 40 also generates a drag flow in it with the rotating motion of the rotor 20, which further increases the pressure in the annular groove 38 and therefore the grooves 24, thus further increasing the contact pressure of the wings 26 against the circumferential wall 18. In particular, this drag flow generates a pressure increase in the annular groove 38 even as the vane pump is starting so that the vane pump also delivers a sufficient fuel quantity when starting. The curved path of the connecting groove 40 also assures that with the rotary motion of the rotor 20, the wings 26 move across the connecting groove 40 in an approximately tangential fashion, which minimizes the wear on the wings 26 and the housing end wall 14, 16.

It is possible for the annular groove 38 and the connecting groove 40 that connects it to the pressure groove 34 to be provided only in one housing end wall 14 or 16, or for a respective annular groove 38 and connecting groove 40 to be provided in both of the housing end walls 13 and 14 and then to preferably be arranged in mirror image fashion to one another in the housing end walls 14 and 16. It is also possible for a respective annular groove 38 to be provided in both of the housing end walls 14 and 16, but for a connecting groove 40 to be provided in only one housing end wall 14 or 16. It is also possible for the suction groove 30 and/or the pressure groove 34 to be provided in only one housing end wall 14 or 16, whereas the other housing end wall 16 or 14 is embodied as smooth, or for a respective suction groove 30 and/or pressure groove 34 to be provided in both of the housing end walls 14 and 16 and then to preferably be arranged in mirror image fashion to one another in the housing end walls 14 and 16. In this instance, the suction opening 28 and the pressure opening 32 are provided in only one housing end wall 14 or 16. Due to the mirror image arrangement of the suction grooves 30 and pressure grooves 34 as well as of the annular grooves 38 and the connecting grooves 40 in the two housing end walls 14 and 16, the rotor 20 and the wings 26 are subjected to at least approximately the same load on both sides in the axial direction so that little or no resulting force oriented toward the rotation axis 13 is exerted on the rotor 20 and the wings 26. For example, the depth of the annular groove 38 and the connecting groove 40 in the housing end wall 14, 16 is preferably approximately 0.1 to 2 mm; preferably the width of the grooves 38 and 40 is less than their depth.

Figure 4:
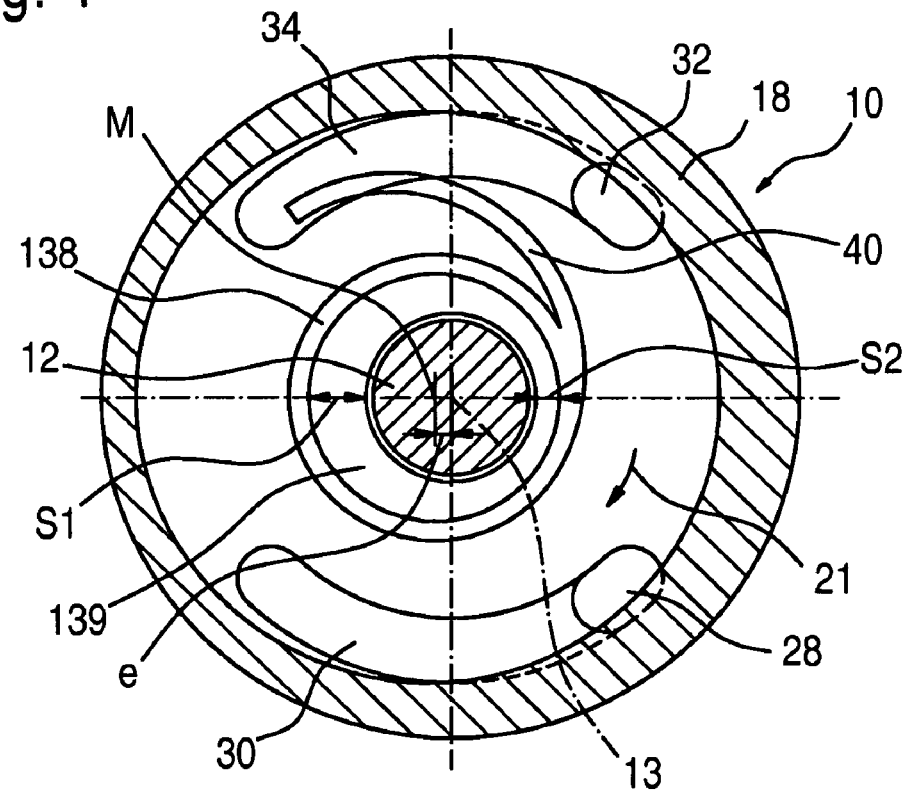
FIG. 4 shows a cross section through the vane pump according to a second exemplary embodiment.

FIG. 4 shows the vane pump according to a second exemplary embodiment whose structure is essentially the same as that of the first exemplary embodiment, but the arrangement of the annular groove 138 has been modified. By contrast with the first exemplary embodiment, the annular groove 138 is situated eccentrically in relation to the rotation axis 13 of the rotor 20. For example, the annular groove 138 is at least approximately circular and its center point M is offset from the rotation axis 13 of the rotor 20 by distance e that constitutes the eccentricity. Preferably, the eccentricity e of the annular groove 138 is at least approximately of the same magnitude and oriented in the same direction as the eccentricity of the inside of the circumferential wall 18 of the pump housing 10. Preferably, the center point M of the annular groove 138 is offset in relation to the rotation axis 13 toward a region of the circumferential wall 18 situated between the suction groove 30 and the pressure groove 34 in the rotation direction 21 of the rotor 20. This eccentric embodiment of the annular groove 138 increases the radial span s1 of the sealing region 139 inside the annular groove 138 in relation to the drive shaft 12 toward which the center point M is offset in relation to the rotation axis 13, while decreasing the radial span s2 of the sealing region 139 on the opposite side. It is also possible for the annular groove 138 not to be embodied as circular, but to have an eccentric path in relation to the rotation axis 13 in which the radial span s1 of the sealing region 139 in a region situated between the suction groove 30 and the pressure groove 34 in the rotation direction 21 of the rotor 20 is greater than the radial span s2 of the sealing region 139 in the opposite region.

The foregoing relates to a preferred exemplary embodiment of the invention, it being understood that other variants and embodiments thereof are possible within the spirit and scope of the invention, the latter being defined by the appended claims.

The invention claimed is:

1. A vane pump comprising a pump housing containing a rotor driven in rotary fashion by a drive shaft, a number of grooves formed in the rotor and distributed over its circumference, the grooves extending at least essentially in the radial direction in relation to the rotation axis of the rotor, a wing-shaped delivery element guided in sliding fashion in each groove, a circumferential wall surrounding the rotor and extending eccentrically in relation to its rotation axis, against which wall the radially outer ends of the delivery elements rest, housing end walls of the pump housing that adjoin the rotor in the direction of its rotation axis, the delivery elements being adapted to deliver medium from a suction region to a pressure region offset from it in the rotation direction of the rotor upon rotation of the rotor, an annular groove extending over part of the circumference of the rotor in one of the housing end walls, the annular groove being situated opposite the inner regions that are delimited in the grooves of the rotor by the delivery elements, the annular groove extending over the entire circumference of the rotor, a pressure groove in said housing end wall in said pressure region, and a connecting groove in said housing end wall providing communication between the annular groove and the pressure groove in said housing end wall, the connecting groove extending from the pressure groove radially inward in the rotation direction of the rotor to the annular groove, wherein the connecting groove extends in spirally curved fashion.

2. The vane pump according to claim 1, wherein the connecting groove feeds in an at least approximately tangential fashion into the annular groove and into said pressure groove.

3. The vane pump according to claim 2, wherein the connecting groove feeds into the end region of the pressure groove oriented counter to the rotation direction of the rotor.

4. The vane pump according to claim 2, wherein the annular groove extends eccentrically in relation to the rotation axis of the rotor.

5. The vane pump according to claim 1, wherein the annular groove extends eccentrically in relation to the rotation axis of the rotor.

6. The vane pump according to claim 5, wherein the annular groove extends in an at least approximately circular fashion and its center point is offset in relation to the rotation axis of the rotor toward a region of the circumferential wall of the pump housing located between the suction region and the pressure region in the rotation direction of the rotor.

7. The vane pump according to claim 5, wherein the annular groove is situated in a circumferential region, which is located between the suction region and the pressure region in the rotation direction of the rotor and which has a greater radial distance from the rotation axis of the rotor than in the opposite circumferential region.

8. A vane pump comprising a pump housing containing a rotor driven in rotary fashion by a drive shaft, a number of grooves formed in the rotor and distributed over its circumference, the grooves extending at least essentially in the radial direction in relation to the rotation axis of the rotor, a wing-shaped delivery element guided in sliding fashion in each groove, a circumferential wall surrounding the rotor and extending eccentrically in relation to its rotation axis, against which wall the radially outer ends of the delivery elements rest, housing end walls of the pump housing that adjoin the rotor in the direction of its rotation axis, the delivery elements being adapted to deliver medium from a suction region to a pressure region offset from it in the rotation direction of the rotor upon rotation of the rotor, an annular groove extending over part of the circumference of the rotor in one of the housing end walls, the annular groove being situated opposite the inner regions that are delimited in the grooves of the rotor by the delivery elements, the annular groove extending over the entire circumference of the rotor, a pressure groove in said housing end wall in said pressure region, and a connecting groove in said housing end wall providing communication between the annular groove and the pressure groove in said housing end wall, the connecting groove extending from the pressure groove radially inward in the rotation direction of the rotor to the annular groove, wherein the annular groove extends eccentrically in relation to the rotation axis of the rotor.

9. The vane pump according to claim 8, wherein the annular groove extends in an at least approximately circular fashion and its center point is offset in relation to the rotation axis of the rotor toward a region of the circumferential wall of the pump housing located between the suction region and the pressure region in the rotation direction of the rotor.

10. The vane pump according to claim 8, wherein the annular groove is situated in a circumferential region, which is located between the suction region and the pressure region in the rotation direction of the rotor and which has a greater radial distance from the rotation axis of the rotor than in the opposite circumferential region.

11. A vane pump comprising a pump housing containing a rotor driven in rotary fashion by a drive shaft, a number of grooves formed in the rotor and distributed over its circumference, the grooves extending at least essentially in the radial direction in relation to the rotation axis of the rotor, a wing-shaped delivery element guided in sliding fashion in each groove, a circumferential wall surrounding the rotor and extending eccentrically in relation to its rotation axis, against which wall the radially outer ends of the delivery elements rest, housing end walls of the pump housing that adjoin the rotor in the direction of its rotation axis, the delivery elements being adapted to deliver medium from a suction region to a pressure region offset from it in the rotation direction of the rotor upon rotation of the rotor, an annular groove extending over part of the circumference of the rotor in one of the housing end walls, the annular groove being situated opposite the inner regions that are delimited in the grooves of the rotor by the delivery elements, the annular groove extending over the entire circumference of the rotor, wherein the annular groove extends eccentrically in relation to the rotation axis of the rotor, and a connecting groove in said one of the housing end walls providing communication between the annular groove and the pressure region, the connecting groove extending from the pressure region radially inward in the rotation direction of the rotor to the annular groove.

12. A vane pump comprising a pump housing containing a rotor driven in rotary fashion by a drive shaft, a number of grooves formed in the rotor and distributed over its circumference, the grooves extending at least essentially in the radial direction in relation to the rotation axis of the rotor, a wing-shaped delivery element guided in sliding fashion in each groove, a circumferential wall surrounding the rotor and extending eccentrically in relation to its rotation axis, against which wall the radially outer ends of the delivery elements rest, housing end walls of the pump housing that adjoin the rotor in the direction of its rotation axis, the delivery elements being adapted to deliver medium from a suction region to a pressure region offset from it in the rotation direction of the rotor upon rotation of the rotor, a suction opening extending through a housing end wall and feeding into the suction region, and a pressure opening extending through said end wall and feeding into the pressure region, an annular groove extending over part of the circumference of the rotor in said housing end wall, the annular groove being situated opposite the inner regions that are delimited in the grooves of the rotor by the delivery elements, the annular groove extending over the entire circumference of the rotor, a connecting groove in said housing end wall providing communication between the annular groove and the pressure region, the connecting groove extending from the pressure region radially inward in the rotation direction of the rotor to the annular groove, and wherein the pressure region includes a pressure groove and the suction region includes a suction groove; the suction opening feeds into the suction groove; and the pressure opening feeds into the pressure groove.

* * * * *